US006109607A

United States Patent [19]

Cartwright et al.

[11] Patent Number: 6,109,607

[45] Date of Patent: Aug. 29, 2000

[54] AIR HOCKEY DEVICE

[76] Inventors: Thomas Cartwright, 110 Perrywinkle Cir., Stuart, Fla. 34996; Samuel H. Bowers, 1601 SW. 120 Ave., Pembroke Pines, Fla. 33025

[21] Appl. No.: 08/965,184

[22] Filed: Nov. 6, 1997

[51] Int. Cl.[7] ..... A63F 7/06

[52] U.S. Cl. ..... 273/108.1; 273/126 A; 473/14

[58] Field of Search ..... 273/126 R, 126 A, 273/108.1; 473/10, 14

[56] References Cited

U.S. PATENT DOCUMENTS

| | | | |
|---|---|---|---|
| 3,722,888 | 3/1973 | Ducharme | 273/126 R |
| 3,773,325 | 11/1973 | Crossman et al. | 273/126 A |
| 3,887,187 | 6/1975 | Crossman et al. | 273/126 A |
| 3,931,974 | 1/1976 | Goldfarb et al. | 273/126 R |
| 4,927,140 | 5/1990 | Pappas | 473/11 X |
| 5,029,861 | 7/1991 | Driska | 273/126 A X |
| 5,356,143 | 10/1994 | Hylak | 273/126 A |

*Primary Examiner*—Raleigh W. Chiu
*Attorney, Agent, or Firm*—Malloy & Malloy, P.A.

[57] ABSTRACT

An air hockey assembly including a playing table having a playing surface defined by two panel segments each having a hollow interior region and an outer planar surface. When the panel segments are joined together they define a conventionally dimensioned air hockey structure which includes an air supply assembly comprising a blower or like air source disposed in a location which does not interfere with the playing surface and does not prevent the playing table from being removably mounted on a preexisting support platform such as, but not limited, a pool table, gaming table or like support platform.

7 Claims, 3 Drawing Sheets

AIR HOCKEY DEVICE

BACKGROUND OF THE INVENTION

1. Field of the Invention

This invention relates to a portable air hockey assembly which may be readily assembled for playing or disassembled for storage and specifically designed to be removably supported on a preexisting support platform, such as but not necessarily limited to a pool table depending upon the embodiment of the invention utilized.

2. Description of the Related Art

The game of air hockey has been known and widely played for many years. Typically, this game requires an air hockey table including a large, elongated substantially planar playing surface. Indeed, the conventional, full-size table is quite large and requires a great degree of space.

The existing air hockey assemblies of the type described above, have generally incorporated a free standing table or platform on which the playing surface is built. The air hockey table or platform comprises a large, flat, perforated surface that forms the aforementioned playing surface as well as what may be considered a top of a pressurized air chamber or plenum. The pressurized air is introduced into the plenum chamber by an electrically powered blower or fan generally mounted in a conventional location below and exterior of the plenum chamber, for example on the undersurface thereof. Moreover, this mounting location is dictated by the standard design which simplifies construction and which maximizes the balance of pressurized air throughout the chamber and beneath the playing surface. As the pressurized air is released through the plurality of apertures formed in the playing surface, lift or buoyancy is given to the game puck so that it effectively glides along the playing surface due to the reduced friction between the puck and the playing surface due.

Prior art structures of type set forth above, however, are constructed as self contained, free-standing units, and accordingly do not provide or suggest any structure or even the desire or need, to effectively portabilize the full size air hockey table or assembly. In particular, because of the space taken up by the assembled air hockey table, and because of the substantially extensive dis-assembly which must take place if it is to be stored, a user of an air hockey table must have a dedicated installation and use location. Indeed, because players will often lean on the table, exerting downward pressure thereon, known air hockey tables include necessarily large, securely affixed, free standing, support bases or platforms that are permanently attached to the playing surface. Moreover, the support platform used with existing air hockey tables must be constructed with an open central region, as existing air hockey devices will generally mount the blower in the vicinity beneath the playing surface and air chamber, and exteriorly thereof, so as to make the underside a non-uniform shape and thereby reduces the possibility of allowing the playing surface to be selectively positioned on a flat or pre-existing support platform, such as a pool or gaming table which of course would be highly desirable.

Specifically, there is a recognized need in this area for what may be considered a portable air hockey assembly which includes a modular construction defined by detachable sections. When such a preferred structure is assembled, it should preferably be structured to be effectively supported almost on any preexisting support platform such as a pool table, like gaming table or any type of support surface of sufficient dimension and configuration to provide adequate stability during the playing of the air hockey game at its full dimensions, thereby eliminating the need to have a dedicated area of a room if the game is to be played.

Attempts have been made in the prior art to provide a structure which is usable for playing the game of air hockey and which is more versatile in terms of adapting such an air hockey structure for use in combination with an existing pool table. However, known structures of this type are still limited in that they are intended to be used only in combination with a "multipurpose" pool or game table which requires that the pool table must be raised by mechanical means to allow the entrance of an air hose to supply proper air flow. Also, the disk or puck used on the air hockey playing surface is intended to utilize the cushioned rails of the pool table of which it is a part. Accordingly, such devices cannot be implemented with existing gaming or support surfaces of a user, and are often quite complex to install and or assemble. Indeed, no such device is configured so as to be effectively useable at any support surface, while still providing the enjoyment of playing a full size air hockey game whenever desired and without a great degree of set up required. The assembly of the present invention is structured to overcome these deficiencies in the prior art and provide a solution to the aforementioned problems.

SUMMARY OF THE INVENTION

The present invention relates to an air hockey assembly which may be portable to the extent that when in its fully assembled form, it may be mounted on a pre-existing support platform which serves to properly orient the playing surface in a substantially horizontal position. More specifically, the subject air hockey assembly comprises a playing table preferably defined by a modular construction including two panel segments of substantially equal dimension and configuration. The panel segments each include a hollow interior region, the regions being segregated from one another when the panel segments are joined to form the playing table. Further, a playing surface is defined by outer planar surface segments formed on each panel segment. The result is a conventionally configured playing surface when the panel segments are joined in the intended fashion.

The playing surface includes a plurality of apertures collectively distributed in a substantially even array over the entire surface area thereof. These plurality of apertures pass completely through the playing surface and establish fluid communication with the respective hollow interior regions of the panel segments. The even distribution of the plurality of apertures is beneficial since there must be a substantially even flow of air over the playing surface in order to give the hockey puck proper lift or buoyancy during playing of the game.

An air supply assembly is provided to introduce air into the hollow interior region of the playing table which, as set forth above, is preferably defined by the hollow interior regions of the two panel segments. The air supply assembly includes at least one air source, such as an electrically powered fan or blower which, depending upon the embodiment of the present invention, forces air directly into the hollow interior regions of the panel segments by means of duct structure or piping serving to interconnect the air blower to the hollow interior regions through one or more points. In a preferred embodiment, to be described in detail hereinafter, the air source or blower may be free standing and located a remote, spaced distance from the playing table when in its operative position. Such a positioning of the air source will allow the assembled playing table to be mounted on any type of support surface which accomplishes the horizontal, substantially level orientation of the playing surface in the desired manner.

Other embodiments of the present invention include the air blower being mounted directly on the playing table, in a location which does not interfere with the playing of the game or the travel of the puck over the playing surface, nor the positioning of the playing surface on an underlying support surface. In such an embodiment, the air blower may have one or more air outlets which are constructed to be removably attached to air inlet ports formed in the playing table. In turn, the inlet ports establish direct fluid communication with the hollow interior portions of the two panel segments defining the playing table. Regardless of the embodiment utilized, however, the air supply assembly establishes an essentially balanced pressurization of the hollow interior of the playing table. This in turn will create a substantially equalized flow of air through the evenly distributed plurality of apertures in the playing surface over which the puck travels at relative high speeds as the game is played. To accomplish this, the subject air supply assembly preferably also includes an air distribution structure located within the hollow interior.

The air distribution structure, again dependent upon the individual embodiment utilized, may include a plurality of air directing vanes to direct the inflow of air from the air source equally throughout the hollow interior portion in which the plurality of vanes are mounted. Also, the air distribution structure may further include a plurality of baffles, also disposed in interruptive relation to the inflow of air from the air source so as to regulate the speed of air entering into a particular hollow interior region.

Therefore, it should be readily apparent that the present invention fulfills the needs and requirements for a somewhat portable air hockey assembly which may be mounted for proper positioning during playing on any type of preexisting support platform such as, but not limited to, a pool table, gaming table, etc. The subject air hockey assembly should preferably have a somewhat modular construction in that certain components thereof may be disassembled for efficient storage, and the overall construction should be lightweight so that adults and children alike may easily assemble or disassemble the various modular components of the subject air hockey assembly for use or storage.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
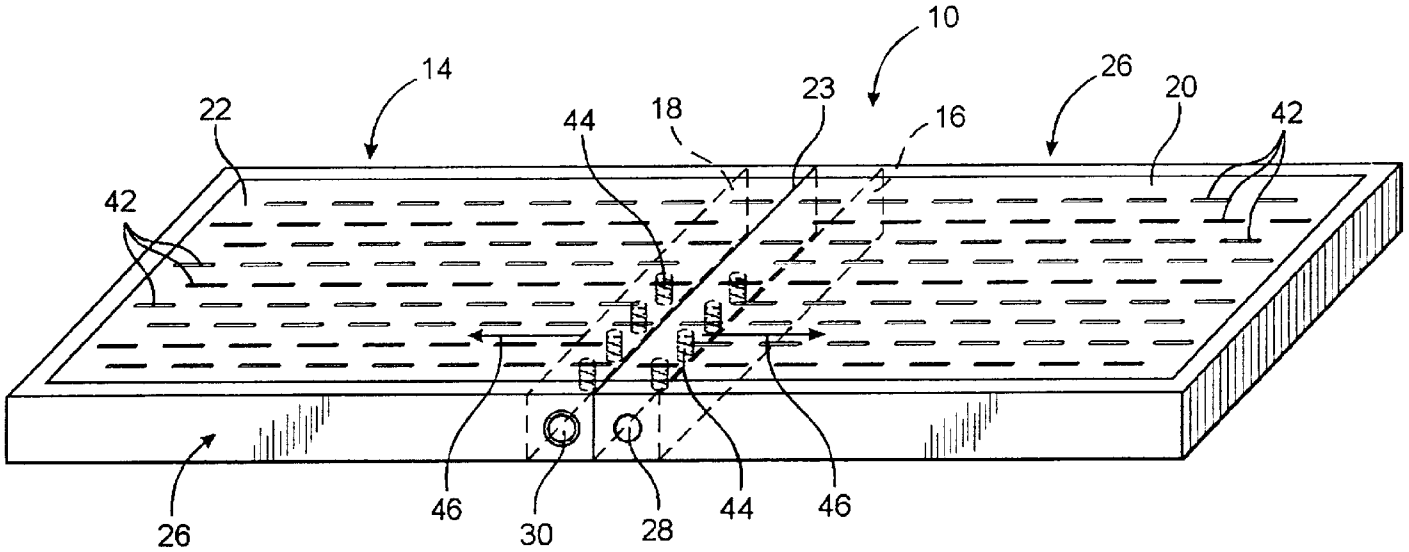
FIG. 1 is a perspective view of the playing table of the subject air hockey assembly in its assembled form.

As shown in the accompanying drawings, the present invention relates to an air hockey assembly including a preferred embodiment of a playing table generally indicated as 10 and shown in FIG. 1. The playing table comprises a modular construction preferably defined by two panel segments, generally indicated as 12 and 14. Each of the panel segments includes at least one hollow interior region 16 and 18 located immediately beneath outer, exposed, preferably substantially planar surfaces 20 and 22. Of course a number of interconnected or separate regions may define the hollow interior regions 16 and 18. To position the playing table 10 in its operative position for playing, the two panel segments 12 and 14 are joined together along correspondingly positioned ends, as clearly shown in the accompanying figures. The connection or joining of the panel segments 12 and 14 may be accomplished by any applicable means which effectively eliminates any significant spacing between the panel segments 20 and 22 when the playing table 10 is in its operative position. To the contrary, only a joint or seam line as at 23 serves to indicate the location of the separation of the panel segments 12 and 14. Such seam 23 is not interruptive of the travel of a hockey puck used in the air hockey game. Further, a surrounding frame structure as at 26 is disposed about the periphery of the playing surface as defined by the outer surface segments 20 and 22. With reference to the embodiment of FIG. 1, at least one but preferably two air inlets as at 28 and 30 are formed in an outer side of peripheral frame structure 26 so as to communicate with the hollow interiors 16 and 18 of the respective panel segments 12 and 14. The function and positioning of the air inlets 28 and 30 will be explained in greater detail hereinafter with regard to the air supply assembly of the present invention.

Figure 3:
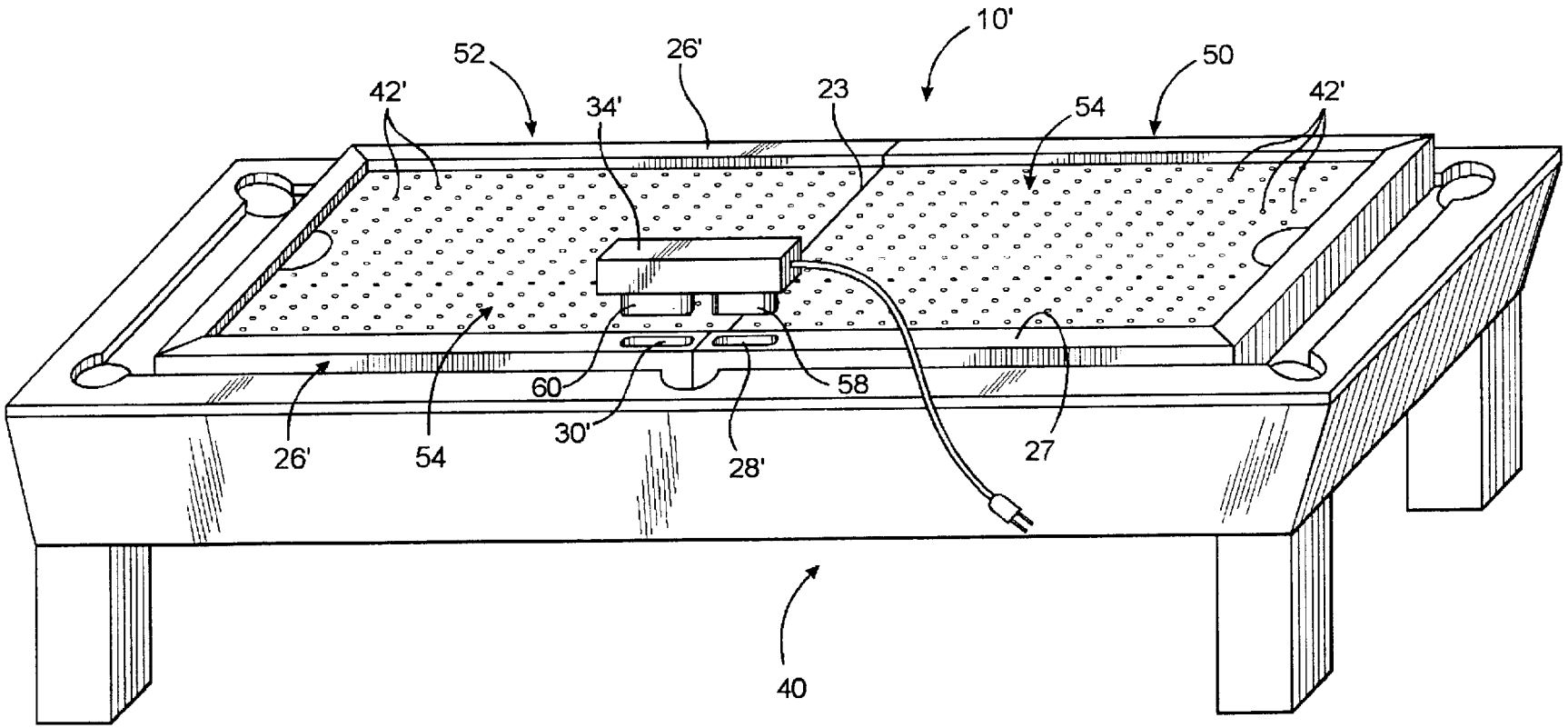
FIG. 3 is a perspective view of another embodiment of the present invention.
Figure 4:
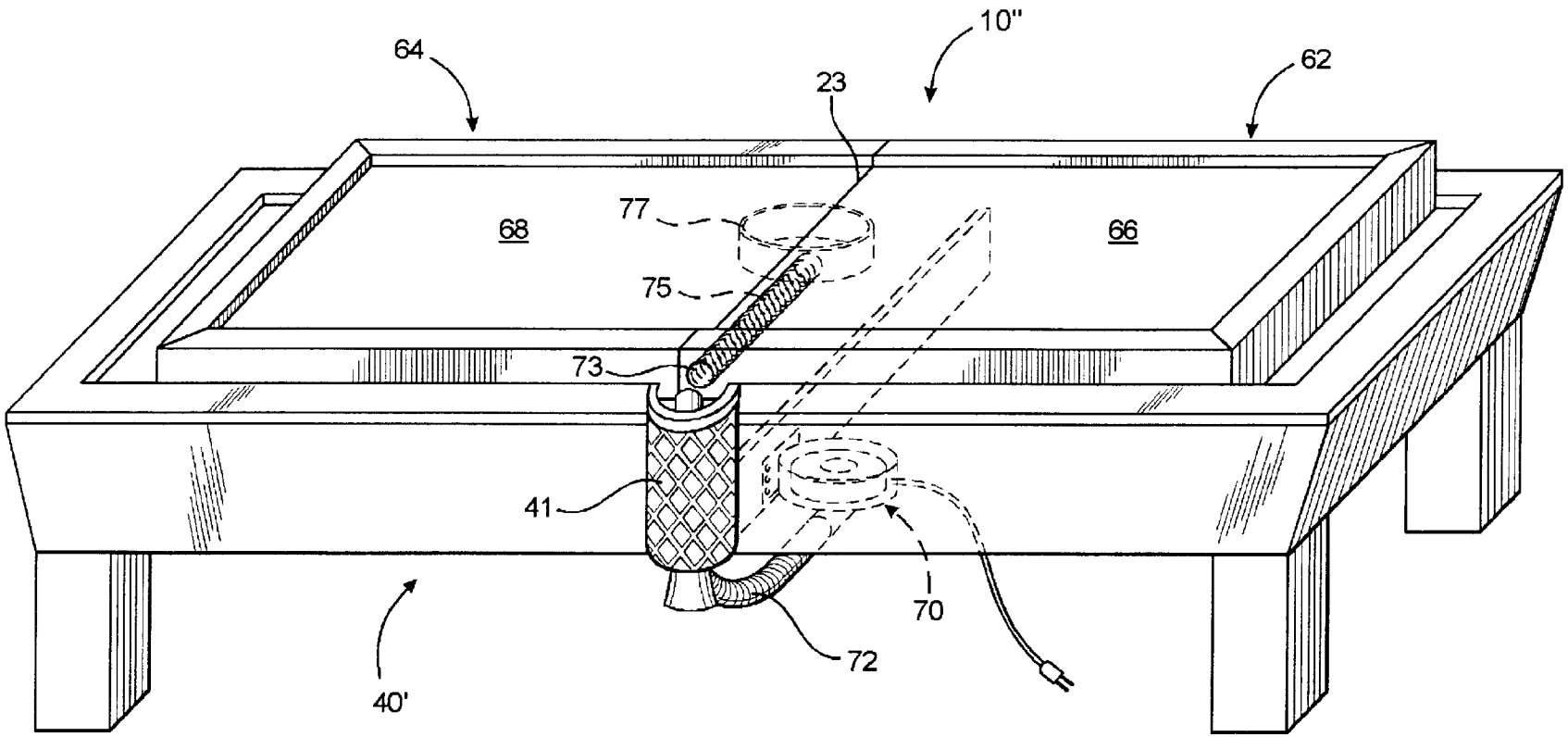
FIG. 4 is a perspective view of yet another embodiment of the present invention.

Based on the structure as described above, it should be apparent therefor, that the playing table 10 is capable of being positioned on any type of preexisting support platform such as a pool table 40 of the type shown in FIGS. 3 and 4. Other types of support platforms may be utilized since there is nothing in the placement or configuration of the structural components of the playing table 10 which would interfere with it being placed on other types of support platforms as long as the playing table and surface are maintained in a horizontal, substantially level position.

Figure 2:
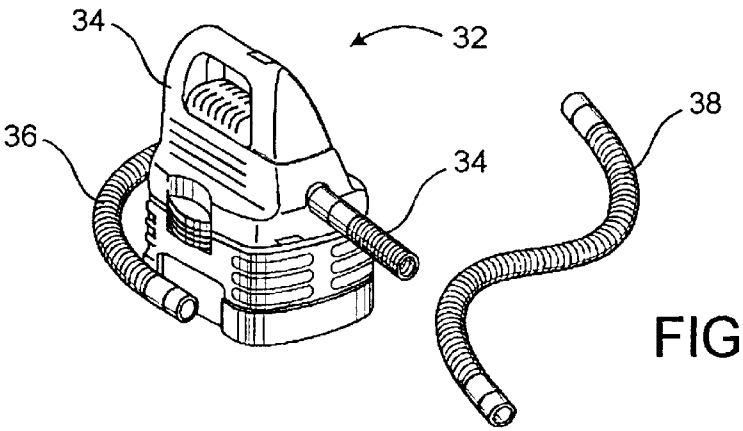
FIG. 2 is a perspective view of the components of the air supply assembly of the present invention.

Again, with regard to the preferred embodiment of FIGS. 1 and 2, the subject invention includes the provision of an air supply assembly generally indicated as 32 which includes at least one air source such as an electrically powered blower or fan 34. The blower 34 is designed to be free standing and located in a remote, out of the way, spaced relation from the playing table 10 and is connected to the playing table by the duct structure 36 and 38. Appropriate ends of the duct structure are specifically dimensioned and configured to be removably attached within the air inlets 28 and 30. By virtue of this connection, fluid communication is established as air is delivered from the blower or air source 34, through the various duct structure 36 and 38 into the inlets 28 and 30 and eventually into the hollow interior regions 16 and 18.

The preferably pressurized air within the hollow interior portions 16 and 18 is eventually delivered in a substantially equalized pattern of air flow to the exposed playing surface defined by the surfaces 20 and 22 of the respective panel segments. To accomplish this, a plurality of apertures as at 42 found in both the surface segments 20 and 22 establish fluid communication between the hollow interior regions 16 and 18 and the respective playing surface segments. More specifically, as air is directed into the hollow interior regions 16 an 18, upon activation of the blower 34, the hollow interior regions 16 and 18 become pressurized. This in turn forces air through the apertures 42 so as to create a substantially equalized flow or passage of air to the playing surface, thereby allowing the puck used in the playing of the game to freely travel over the playing surface because of the reduction of friction between the puck and playing surface.

In order to ensure a balanced pressurization throughout the hollow interior regions 16 and 18, a plurality of baffles and/or vanes 44 are preferably disposed in the hollow interior regions 16 and 18 of each of the panel segments 12 and 14. These baffles and vanes 44 define what may be termed an air distribution structure and are positioned in interruptive relation to the inflow of air from the inlets 28 and 30. As indicated by directional arrows 46, the interruptive disposition of the baffles and vanes 44 is such as to direct air away from the respective inlets 28 and 30 and throughout the remainder of the respective hollow interior regions 16 and 18. Of course, a plurality of different air distribution structures may also be utilized and/or disposed in one or more different locations throughout the present invention.

The embodiment shown in FIG. 3 differs primarily from the embodiment of FIG. 1 in that the air supply assembly comprises a different structural configuration of the air source. The air source is defined in the embodiment of FIG. 3 as an electrically powered fan or blower 34' which is dimensioned and configured to be removably connected to and supported directly on the playing table 10' when in its assembled position, as shown. More specifically, the two panel segments 50 and 52 of this embodiment are joined to one another along the same correspondingly positioned ends as defined by the transverse seam 23. However, the frame portion 26' surrounding the playing surface 54 includes one or more air inlets 28' and 30' located on an upper exposed surface 27 of the peripheral frame 26 rather than on the outer side thereof, as shown in FIG. 1. Further, the air inlets 28' and 30' are configured to removably receive air outlets 58 and 60 therein. Fluid communication is thereby established between the blower 34' and the hollow interior portions of the panel segments 50 and 52. An air distribution structure of the type disclosed in FIG. 1 comprising the various vanes and baffles 44 may be mounted on the interior of the respective hollow interior regions of panel segments 50 and 52 so as to equally distribute the air throughout the panel segments and accomplish the aforementioned balanced pressurization of air within these segments.

With regard to the embodiment of FIG. 4, the playing table 10" still comprises a modular construction defined by the removable connection of the panel segments 62 and 64 along the seam 23. However, in this embodiment, the hollow interior regions 66 and 68 of the respective panel segments 62 and 64 are supplied with air by means of another embodiment of the air supply assembly. The air supply assembly of FIG. 4 includes an electrically powered blower or fan generally indicated as 70 and specifically designed to be mounted beneath a preexisting support platform 40'. The support platform 40' may take the form, specifically in this embodiment, of a pool table including a plurality of external pockets as at 41. The blower 70 is fixedly secured to some type of mounting structure located beneath the support platform 40' and is connected in fluid communication to the interior portions 66 and 68 by means of an externally mounted air duct 72. The air duct extends up through the pocket 41 so that it may be positioned in an out of the way location. The external duct 72 enters the playing table 10' through an air inlet as at 73. The air inlet 73 connects with an internal duct structure as at 75 which in turn is attached to a venturi type air distributor 77.

Accordingly, when the air source or blower 70 is activated, air flows freely through the external duct 72 mounted within external pocket 41, through the air inlet 73 and along the length of the internal duct 75. The air reaches the venturi type distributor 77 wherein it is evenly distributed throughout the entirety of both the hollow interior regions 66 and 68 of the respective panel segments 62 and 64. This accomplishes the aforementioned balanced pressurization of the hollow interior regions and the equalized distribution of air to the playing surface (not shown) of the playing table 10".

It should be emphasized that regardless of which embodiment of the subject invention is utilized, the various playing tables are specifically structured to be removably mounted on some type of support platform which may or may not be a pool table. Clearly, in the embodiments of FIGS. 1 and 3, a pool table, while adequately sufficing for the horizontal, substantially level orientation of the playing table, is not necessary. To the contrary, in the embodiment of FIG. 4, the pool table is utilized to aid in the positioning of the external duct 72 in a location which will not interfere with the play of the users of the playing table 10". Moreover, the hollow interior regions recited herein, while preferably including a large open area, may be seen to include a plurality of small, individual tubes connected to each aperture for the direct flow of air thereto. As to the air distribution assembly, one or more such assemblies may be provided, and one or more inlets and air flow passages may also be provided.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An air hockey assembly comprising:

a) a pre-existing, unattached support platform, b) a playing table, said playing table structured to be removably mounted on the support platform and including a hollow interior region comprising two segregated segments, c) said playing table further including an exposed playing surface having a substantially planar configuration, d) said playing surface including a plurality of apertures formed therein and disposed in fluid flow communication with said hollow interior region, e) at least one air supply assembly including an air source connected in fluid flow communication with said hollow interior region and structured to deliver a continuous flow of air thereto, f) said air supply assembly further including at least one air distribution structure mounted within said hollow interior region and disposed and structured to distribute air from said air source substantially evenly throughout said hollow interior region, g) said air source and said distribution structure cooperatively structured to define a substantially balanced pressurization of air within said hollow interior region and a substantially even air flow over said playing surface, h) said playing table including a frame structure secured to said playing surface and extending substantially along a periphery thereof, said frame structure comprising at least a first inlet and a second inlet each communicating with a different one of said segregated segments, and i) said air source including at least a first outlet and a second outlet, each structured to be removably attached to a corresponding one of said first and second inlets and being disposed in air delivering relation to a different one of said segregated segments.

2. An air hockey assembly as recited in claim 1 wherein said air source is disposed in remote, spaced relation to said playing table and is connected to said hollow interior region by duct structure structured to direct air flow therethrough.

3. An air hockey assembly as recited in claim 2 wherein said air source is mounted on an under portion of the support platform in spaced relation to the playing table.

4. An air hockey assembly as recited in claim 3 wherein the support platform comprises a conventional pool table having a plurality of pockets disposed in spaced relation to one another generally about a periphery of the pool table, said duct structure extending between the air source and said hollow interior region through at least one of the plurality of pockets.

5. An assembly as recited in claim 1 wherein said air distribution structure comprises a first plurality of air directing members and a second plurality of air directing members, each of said first and second plurality of air directing members positioned within a different one of said segregated segments in a substantially linear array and in receiving relation to air flow entering respective ones of said segregated segments.

6. An air hockey assembly comprising:

a) a pre-existing unattached support platform comprising a conventional pool table, b) said pool table having a plurality of pockets disposed in spaced relation to one another generally about a periphery of said pool table, c) a playing table, said playing table to be removably mounted on said support platform and including a hollow interior region, d) said playing table further including an exposed playing surface having a substantially planar configuration and including a plurality of apertures therein and disposed in fluid communication with said hollow interior region, e) at least one air supply assembly including an air source disposed in remote, spaced relation to said playing table and connected to said hollow interior region by a duct structure disposed to direct a flow of continuous air to said hollow interior region, f) said conventional pool table having a plurality of pockets disposed in spaced relation to one another generally about a periphery of the pool table, said duct structure extending between said air source and said hollow interior region through at least one of said plurality of pockets, g) said air supply assembly including at least one air distribution structure mounted within said hollow interior region and disposed and structured to distribute air from said air source substantially evenly throughout said hollow interior region, h) said air source and said air distribution structure cooperatively structured to define a substantially balanced pressurization of air within said hollow interior region and a substantially even air flow over said playing surface, and i) said playing table including a frame structure secured to said playing surface and extending substantially along a periphery thereof, at least one inlet formed in said frame structure in communicating relation to said hollow interior region.

7. An air hockey assembly comprising:

a) a pre-existing, unattached support platform, b) a playing table, said playing table structured to be removably mounted on the support platform and including a hollow interior region comprising two separable segments, c) said playing table further including an exposed playing surface having a substantially planar configuration, d) said playing surface including a plurality of apertures formed therein and disposed in fluid flow communication with corresponding ones of said separable segments of said hollow interior region, e) at least one air supply assembly including an air source connected in fluid flow communication with said separable segments and structured to deliver a continuous flow of air thereto, f) said air supply assembly further including at least one air distribution structure mounted within said hollow interior region and disposed and structured to distribute air from said air source substantially evenly throughout each of said separable segments, g) said air source and said air distribution structure cooperatively structured to define a substantially balanced pressurization of air within said separable segments of said hollow interior region and a substantially even flow of air over said playing surface, and h) said playing table including a frame structure secured to said playing surface and extending substantially along a periphery thereof, at least one inlet formed in said frame structure in communicating relation to both said separable segments of said hollow interior region.

* * * * *